US012497791B2

(12) United States Patent
Bacon et al.

(10) Patent No.: US 12,497,791 B2
(45) Date of Patent: Dec. 16, 2025

(54) WEDGE FOR A SHORING SYSTEM AND RELATED METHODS

(71) Applicant: TITAN FORMWORK SYSTEMS, LLC, Tempe, AZ (US)

(72) Inventors: David L. Bacon, Tempe, AZ (US); Cody Ives, Tempe, AZ (US)

(73) Assignee: TITAN FORMWORK SYSTEMS, LLC, Tempe, AZ (US)

( * ) Notice: Subject to any disclaimer, the term of this patent is extended or adjusted under 35 U.S.C. 154(b) by 169 days.

(21) Appl. No.: 18/310,654

(22) Filed: May 2, 2023

(65) Prior Publication Data

US 2023/0349174 A1 Nov. 2, 2023

Related U.S. Application Data

(60) Provisional application No. 63/337,479, filed on May 2, 2022.

(51) Int. Cl.
*E04G 11/48* (2006.01)

(52) U.S. Cl.
CPC ..... *E04G 11/483* (2013.01)

(58) Field of Classification Search
CPC ..... E04G 11/38; E04G 11/486; E04G 11/483; E04G 2025/006; E04G 25/066; E04G 25/068; E05C 17/54; E06B 1/6069
USPC ..... 209/207
See application file for complete search history.

(56) References Cited

U.S. PATENT DOCUMENTS 1,922,298 A * 8/1933 Jones ..... E05C 17/54 292/342
1,976,579 A * 10/1934 Reynolds ..... E05C 17/54 292/342
2,796,280 A * 6/1957 Ponder ..... E05C 17/54 16/86 A
2,905,422 A * 9/1959 Sacharow ..... F16B 12/48 29/520
3,516,633 A * 6/1970 Blackwood ..... A47B 13/021 248/188
3,601,438 A * 8/1971 Stuart ..... E05C 17/54 292/253
4,116,615 A * 9/1978 Hall, Jr. ..... G08B 15/004 116/87
7,014,229 B1 * 3/2006 Stelmach ..... E05C 17/54 292/342
9,644,407 B1 * 5/2017 Abramovits ..... E05C 17/54
10,053,875 B1 * 8/2018 Baron ..... E04G 11/50
(Continued)

FOREIGN PATENT DOCUMENTS

EP 2759658 A1 * 7/2014 ..... E04G 11/486
KR 2010010986 A * 2/2010 ..... E04G 11/38
WO WO-2014124695 A1 * 8/2014 ..... E04G 11/02

*Primary Examiner* — Kyle J. Walraed-Sullivan
(74) *Attorney, Agent, or Firm* — Shook Hardy & Bacon L.L.P.

(57) ABSTRACT

This disclosure relates to a wedge for a shoring system. The wedge can include a first side with a first engagement surface and a second side with a second engagement surface. In some examples, the first engagement surface is configured for engaging a drophead of the shoring system, and the second engagement surface is configured for engaging a shore of the shoring system. In examples, the first engagement surface is angled between about 8 degrees and about 12 degrees relative to the second engagement surface.

20 Claims, 6 Drawing Sheets

(56) References Cited

U.S. PATENT DOCUMENTS

| | | | | |
|---|---|---|---|---|
| 10,827,830 | B2 * | 11/2020 | Perelman | F16B 12/52 |
| 12,071,774 | B1 * | 8/2024 | Bond | E04G 11/36 |
| 2003/0102468 | A1 * | 6/2003 | Selzer | A62B 3/005 254/104 |
| 2008/0073474 | A1 * | 3/2008 | Xammar Bove | E04G 25/068 248/354.5 |
| 2016/0060882 | A1 * | 3/2016 | Bond | E04G 25/065 249/13 |
| 2018/0080238 | A1 * | 3/2018 | Lenkin | E04B 5/02 |
| 2018/0340342 | A1 * | 11/2018 | Lizarazu Zaldua | E04G 11/38 |
| 2019/0010716 | A1 * | 1/2019 | Baron | E04G 25/061 |
| 2019/0010717 | A1 * | 1/2019 | Baron | E04G 11/52 |
| 2020/0173183 | A1 * | 6/2020 | Routh | E04G 11/38 |
| 2021/0079670 | A1 * | 3/2021 | Becker | E04G 11/38 |
| 2022/0081917 | A1 * | 3/2022 | Becker | E04G 11/36 |

* cited by examiner

WEDGE FOR A SHORING SYSTEM AND RELATED METHODS

CROSS REFERENCE TO RELATED APPLICATIONS

This application claims the priority benefit of U.S. Provisional Application No. 63/337,479 (filed May 2, 2022), which is hereby incorporated by reference in its entirety.

TECHNICAL FIELD

This disclosure relates to a shoring system for use in construction (e.g., concrete forming) and components thereof. In particular, the present disclosure is related to a wedge for a shoring system (e.g., for attachment to a shoring post) and related methods.

BACKGROUND

Shoring systems are often used during the construction of concrete buildings. The process of shoring includes utilizing a temporary structure for supporting a building floor or other structure during intermediate phases of the construction process. For example, one method of shoring includes utilizing vertical supports (or "shores") for securing a set of temporary floor panels in place. The temporary floor panels provide support for poured concrete until the concrete hardens and achieves sufficient strength to form a permanent reinforced floor. Typically, once the concrete of the permanent floor stabilizes, the shoring system is removed and moved up a level for use during formation of a subsequent (higher) floor of the building.

DETAILED DESCRIPTION OF DRAWINGS

The present systems and methods for a wedge for a shoring system are described in detail below with reference to these figures.

DETAILED DESCRIPTION

Figure 1:
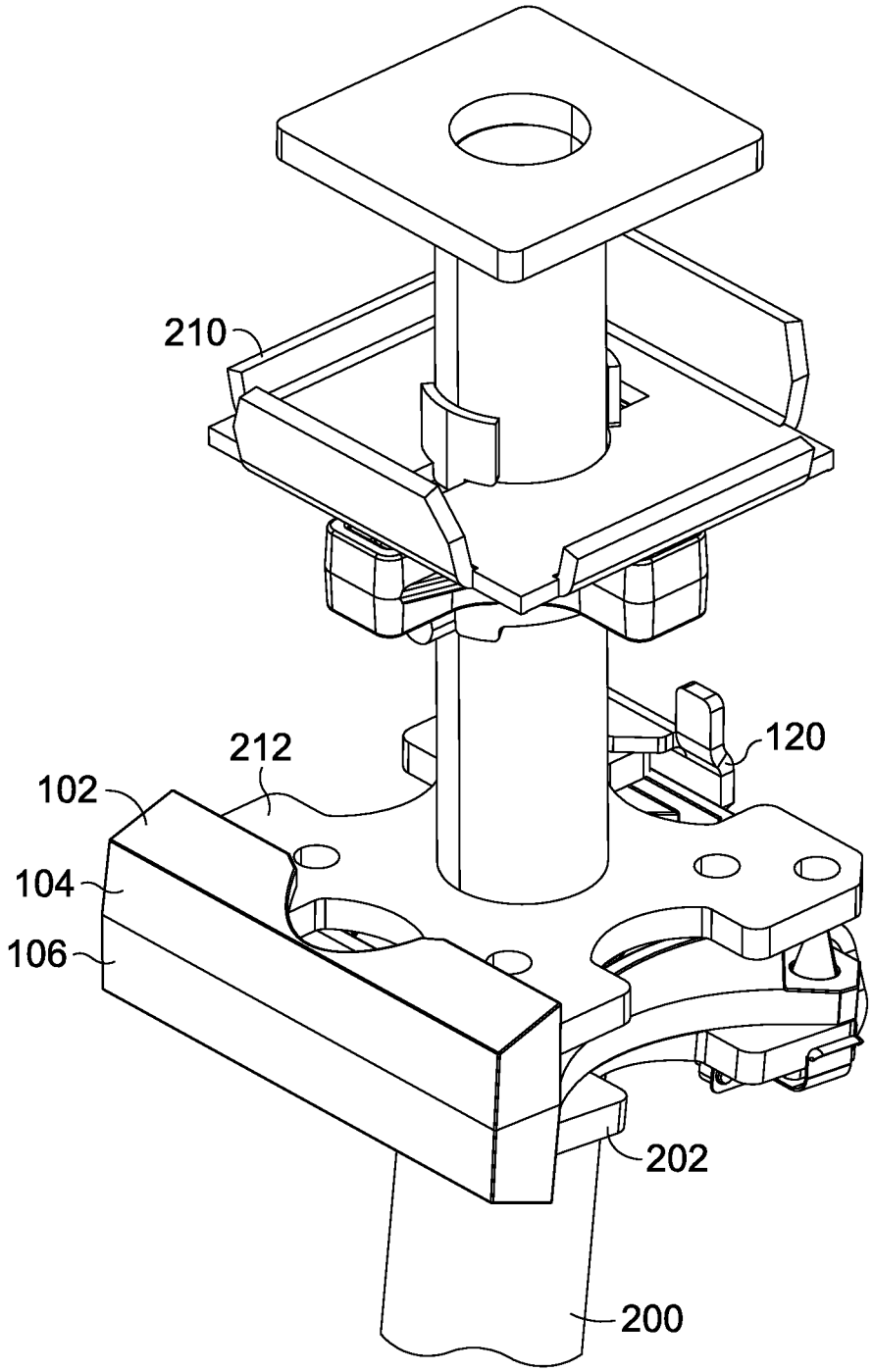
FIG. 1 is a first perspective view of a portion of a shoring system having a wedge in accordance with an example of the present disclosure.

This detailed description is related to a wedge that can be combined with one or more other shoring components to help set or control an angle associated with the one or more other shoring components. For example, the wedge can be positioned at an end of a shoring post to help control the angle of the shoring post relative to a bearing surface and/or to help control the angle of the load relative to the shoring post.

Conventional wedges are often associated with various drawbacks. For example, some conventional wedges can be inefficient to secure in position, and/or even when placed in position, can tend to shift. In addition, some conventional wedges are limited to use with only some times of components and lack universality for use with a broad range of shoring components.

In contrast to conventional solutions, a wedge of the present disclosure includes features that facilitate easier, more efficient, and more secure attachment to other shoring components. For example, a wedge of the present disclosure can include pockets configured to receive portions (e.g., top and bottom plates or brackets) of other shoring components, and the pockets can impeded shifting of the components in multiple directions. In addition, a wedge of the present disclosure can include positioning features that are configured to mate with recesses on the other shoring components to allow the wedge to be "roughed in."

Various aspects are described below with reference to the drawings in which like elements generally are identified by like numerals. The relationship and functioning of the various elements of the aspects may be better understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Figure 5:
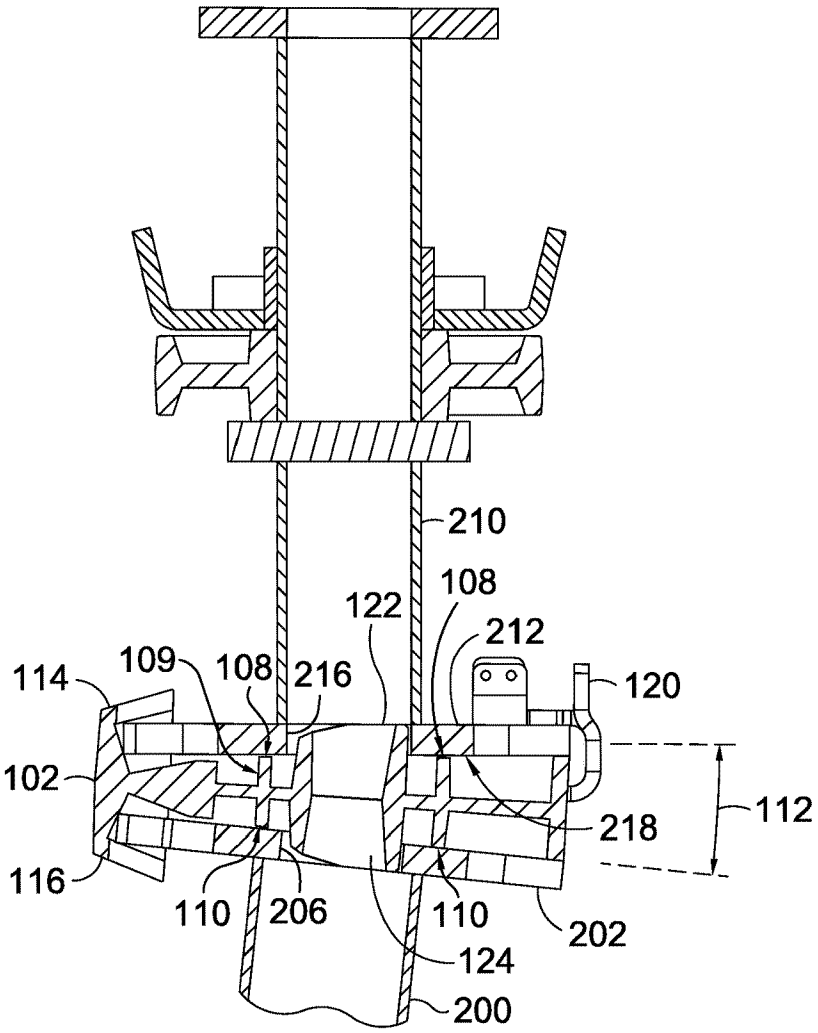
FIG. 5 is a section view of the portion of the shoring system.
Figure 6:
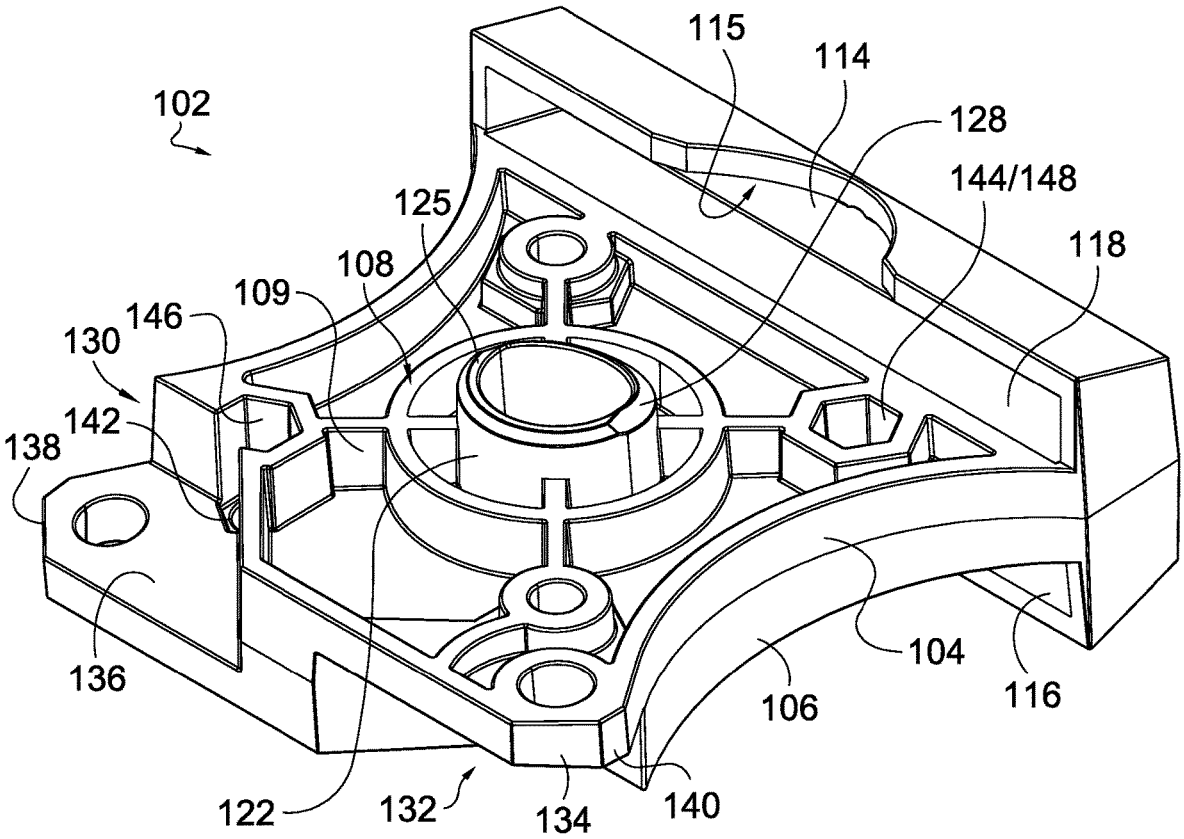
FIG. 6 is a perspective view of the wedge for the shoring system from FIG. 1, where the wedge is depicted in isolation.

FIGS. 1-5 depict examples associated with a wedge 102 installed with secured shoring components, and FIG. 6 shows the wedge 102 in isolation. While the wedge 102 may be located between any appropriate shoring components, the depicted embodiments show the wedge 102 between a top portion 202 of a shore 200 and a bottom portion 212 of a drophead 210 (collectively the "the secured shoring components"). As shown, the top portion 202 of the shore 200 may include a plate that is shaped substantially the same as a plate forming the bottom portion 212 of the drophead 210.

Figure 1A:
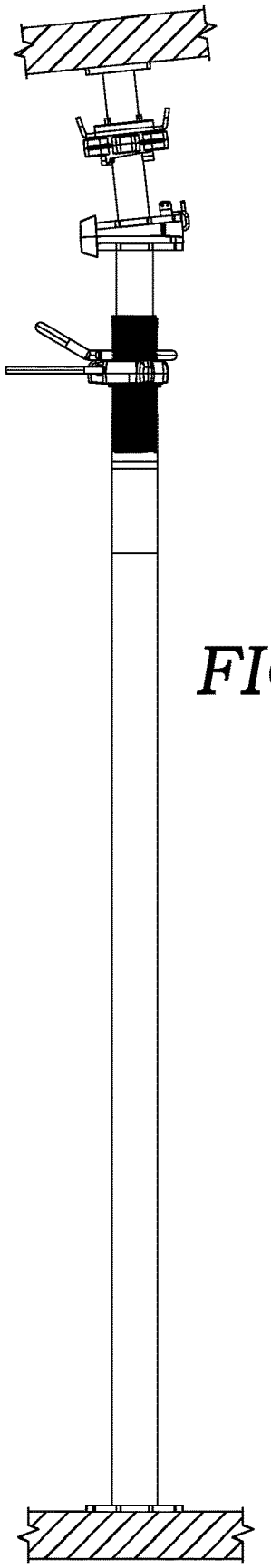
FIGS. 1A and 1B illustrate front elevation views of a shore at different positions relative to a bearing surface and load, in accordance with an example of the present disclosure.
Figure 1B:
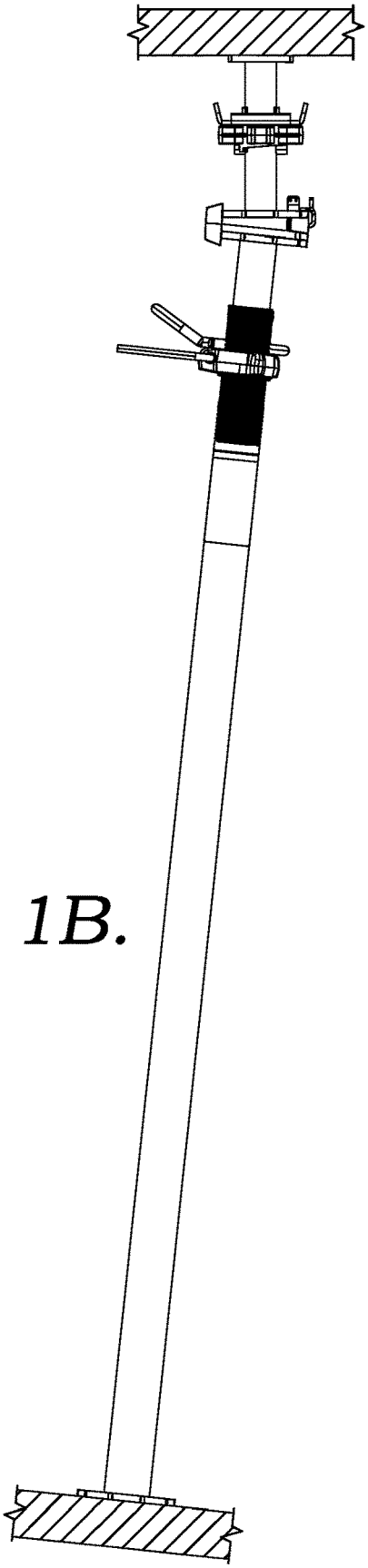

Referring generally to FIGS. 1-6, the wedge 102 generally functions to overcome certain angles encountered during the construction process, which are collectively referred to herein as "ramp angles." For example, the ramp angle may accommodate a ramp (e.g., when constructing a parking garage). When setting up the shore 200 on a ramped surface, this ramp angle must be accounted for by the shoring system, particularly when the drophead 210 may be level relative to the true horizontal for pouring a flat concrete surface above. As discussed herein, the wedge 102 addresses this issue. For example, referring to FIGS. 1A and 1B, a shore 200 is depicted at different angles relative to a bearing surface (e.g., on which the shore 200 is positioned) and a load (e.g., above the shore and supported by the shore and the drophead). Supporting loads at angles can be required in various use cases associated with the shoring components, such as when constructed a ramp or other angled surface. However, examples of the present disclosure are not limited to those use scenarios. In examples of the present disclosure, a wedge 102 can be positioned between the shore 200 and the drophead 210 to help account for the angles and provide an improved load distribution.

As shown, the wedge 102 includes a first side 104 and a second side 106. The wedge 102 may be substantially formed with a metal, such as a steel or other metal with high strength and durability. In addition, the wedge 102 can be formed from other suitable materials. Optionally, the first side 104 may generally include a first plate and the second side 106 may generally include a second plate where the first and second plates are welded or otherwise secured together, but this is not required (e.g., they may alternatively be unitarily formed or cast). Notably, the first side 104 and the second side 106 may be interchangeable. For example, the first side 104 and the second side 106 may be substantially mirrored, at least with respect to the aspects/features that directly engage the secured shoring components. Even when interchangeable, it should be recognized that certain features may be located on only one side (e.g., text engravings, ornamental features, structural features only needed in one instance that do not contact the separate shoring component, etc.).

Advantageously, the interchangeability of the first side 104 and the second side 106 may reduce the need to flip the wedge 102 into a correct orientation during use. This may be advantageous for significantly increasing the speed and ease of installation and prevent dangerous conditions due to incorrect installation (e.g., both orientations are correct).

The first side 104 of the wedge 102 may include a first engagement surface 108, which is generally the contact surface that abuts or otherwise engages the drophead 210 or shore 200 during use. As shown, the first engagement surface 108 may be formed on top of a rib 109, which may also function as a strengthening member that generally surrounds various openings, holes, and other structures on the first side 104 of the wedge 102. The second side 106 of the wedge 102 may include a similar second engagement surface 110 that functions in substantially the same manner.

Figure 4:
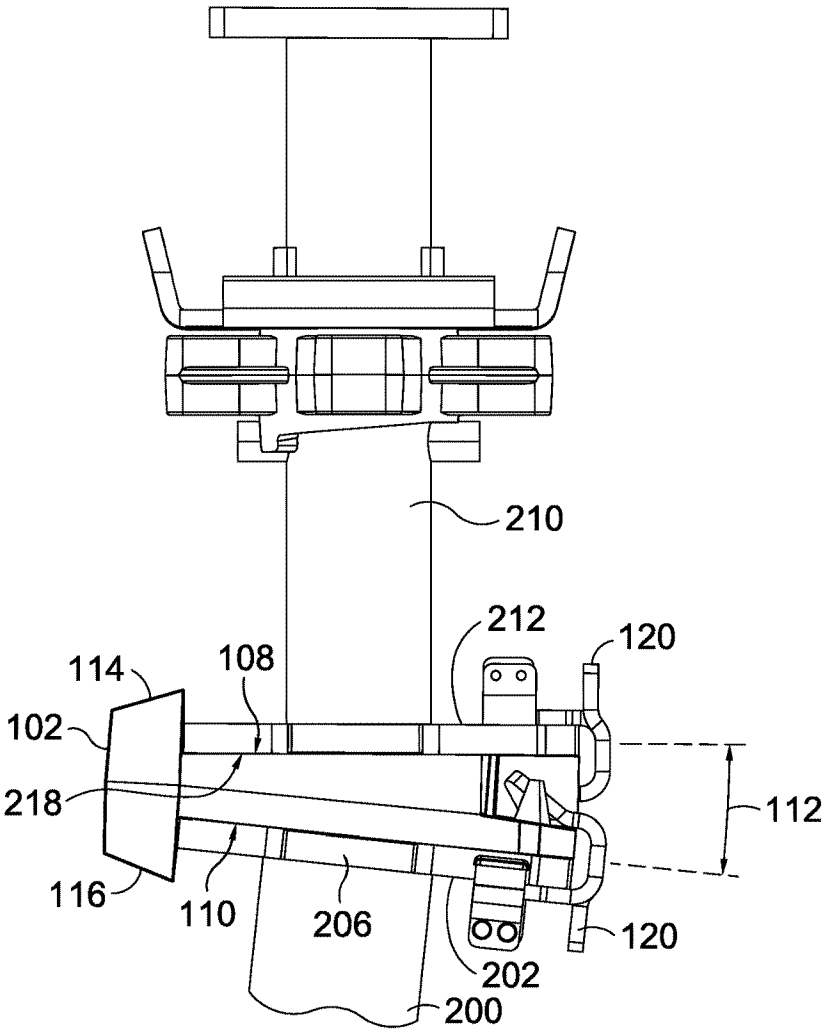
FIG. 4 is a side view of the portion of the shoring system from FIG. 1.

To achieve the "wedge" affect for accommodating a ramp angle, the first engagement surface 108 may be angled relative to the second engagement surface 110, which is illustrated by the depicted wedge angle 112 in FIGS. 4-5. Any suitable wedge angle is contemplated to accommodate any reasonable ramp angle, and it is contemplated that wedges having different wedge angles may be packaged together in a kit to cover multiple circumstances. However, a single wedge angle 112 covering the majority of circumstances is advantageous for most construction situations. In typical applications, the inventors have conceived a wedge angle 112 of between about 8 degrees and about 12 degrees, and more particularly about 10 degrees. Since shoring systems generally have a certain tolerance level where existing components can naturally adjust to angles of about 6 degrees, a wedge 102 having about al 0 degree angle may provide the ability to accommodate ramp angles of about 4 degrees and about 16 degrees, which encompasses a vast majority of ramp angles encountered during construction today.

Figure 2:
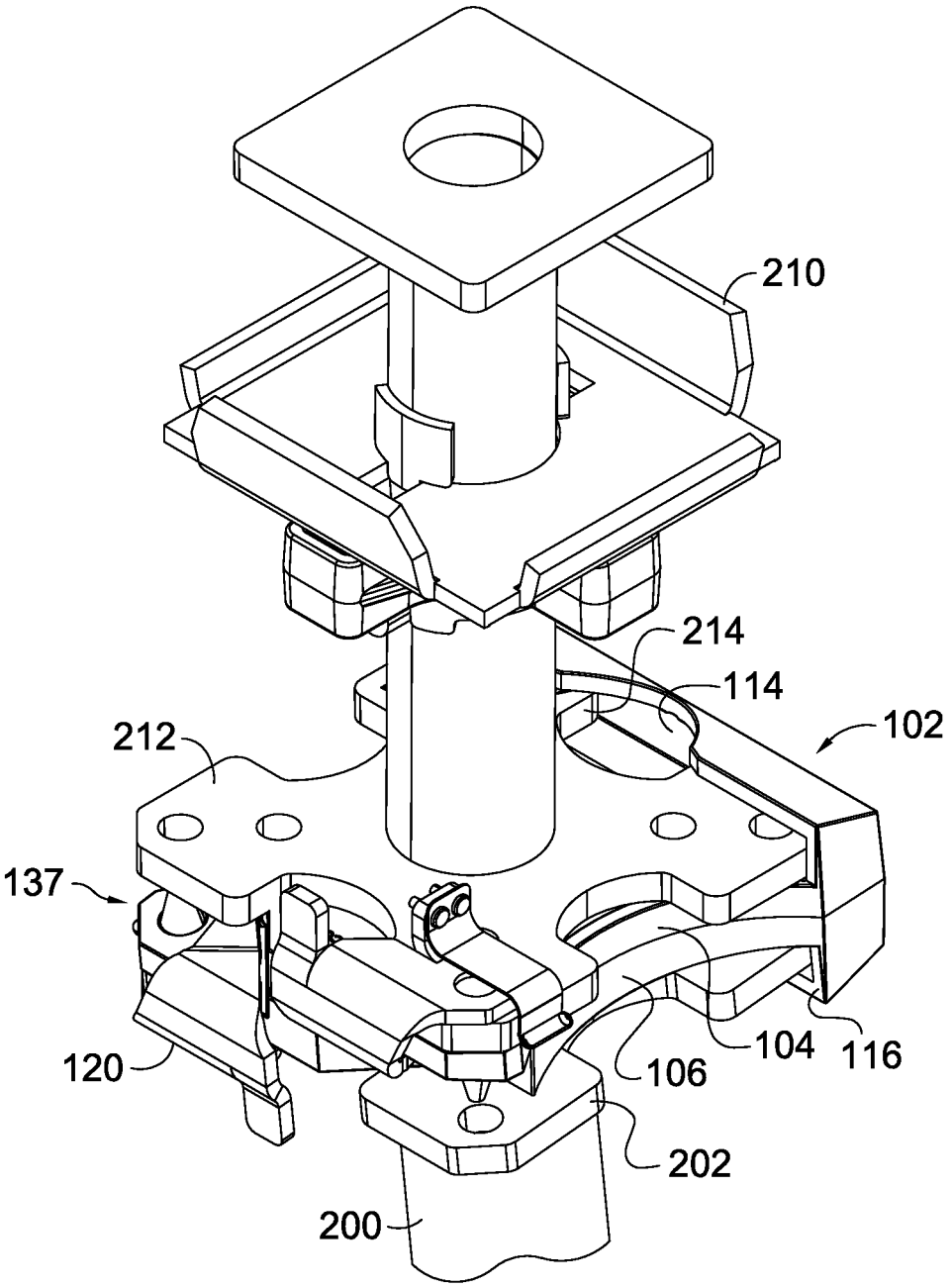
FIG. 2 is a second perspective view of the portion of the shoring system from FIG. 1.
Figure 3:
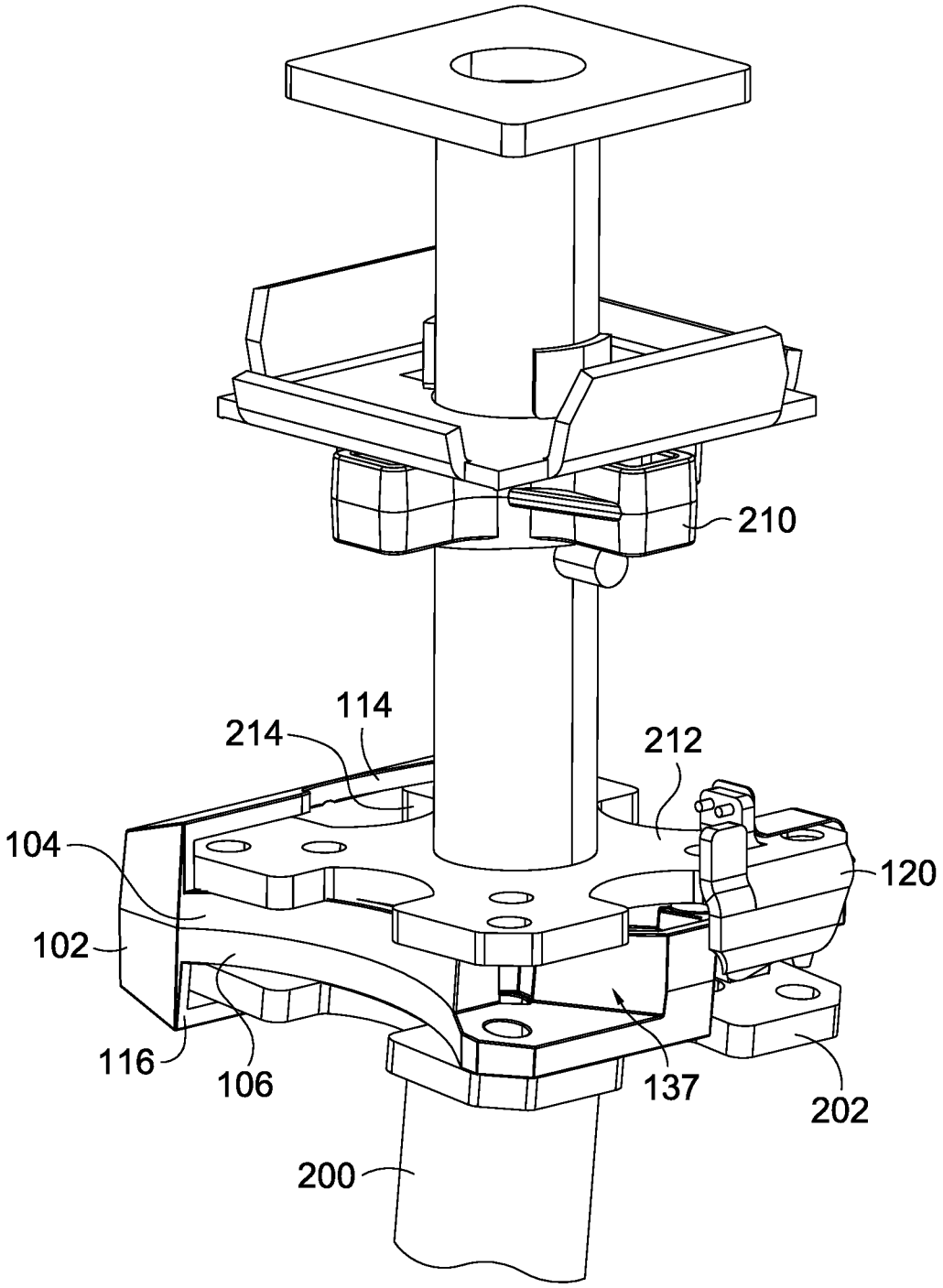
FIG. 3 is a third perspective view of the portion of the shoring system from FIG. 1.

To facilitate installation of the wedge 102 with the secured shoring components, the first side 104 may include a first pocket 114 and the second side 106 may include a second pocket 116 (although only one pocket is contemplated in other embodiments). Referring to the first pocket 114 (and noting the second pocket 116 may be a mirror image), the first pocket 114 includes a pocket opening 118 located adjacent to the first engagement surface 108. The first pocket 114 may be configured (e.g., sized, shaped, and positioned) to receive the bottom portion 212 of the drophead 210 and/or the top portion 202 of the shore 200. For example, as depicted in FIGS. 2-3, an edge 214 of the bottom portion 212 of the drophead 210 may be slidable to its depicted position inside the first pocket 114 when it is installed on the first engagement surface 108. When in the assembled state, the first pocket 114 may generally prevent movement of the drophead 210 in two directions parallel to the first engagement surface 108. To complete securement, a separate securement device, in this case a securement clip 120, may be used (as discussed in more detail below).

The wedge 102 may include one or more positioning structures to ensure the wedge 102 is appropriately positioned relative to the secured shoring components. In the depicted example, the positioning structures include a first stem 122 on the first side of the wedge 102 and a mirrored second stem 124 (FIG. 5) on the second side 106 of the wedge 102. The first stem 122 may generally include a cylindrical protrusion configured for receipt by a central drophead opening 216 of the drophead 210 (and similarly a central shore opening 206 of the shore 200). An outer diameter of the first stem 122 may be approximately equal an inner diameter of the central drophead opening 216 (albeit slightly smaller within a certain tolerance) such that the drophead 210 is generally "roughed" into a suitable operational position even before final securement via installation of the securement clip 120 or other securement device.

One installation method may include first inserting the edge 214 of the bottom portion 212 of the drophead 210 into the first pocket 114 while the bottom portion 212 is extremely angled, thereby having a bottom surface 218 that remains above the first engagement surface 108 and even above the top of the first stem 122. Next, the bottom surface 218 of the drophead 210 may be rotated downward into contact with the first engagement surface 108 while the edge 214 remains within the first pocket 114, and insertion of the first stem 122 within the central drophead opening 216 may occur during this same motion.

To facilitate this installation method, the first stem 122 may include a top face 126 with an angled portion 128, which may provide space such that the first stem 122 does not inhibit the initial motion of the bottom portion 212 as it initially enters the first pocket 114. Similarly, a top surface 115 of the first pocket 114 may be angled to receive the bottom portion 212 of the drophead 210 when in this initially-angled orientation. The angled portion 128 of the first stem 122 and the top surface 115 of the first pocket 114 may be substantially parallel, as they are accommodating the same angled-insertion of the drophead.

It is contemplated that the combination of engagement at the pockets and engagement at the central stems may suitably secure the wedge 102 in place relative to the secured shoring components in the final, weight-bearing assembled state, as all necessary degrees of motion are accounted for. Even so, an additional securement device may be used and advantageous for providing a more stable, durable connection. When used, the securement device may include any suitable structure, and in this case includes the securement clip 120.

To accommodate the securement clip 120, a set of notches (here a first notch 130 and a second notch 132) may be included adjacent to a set of corresponding clip engagement portions (here a first clip engagement portion 134 and a second clip engagement portion 136). The notches may be included such that adequate spaces or cavities 137 (shown in FIGS. 1-3) are provided when in the assembled state such that the securement clip 120 can move in a lever-like fashion for proper operation. For example, referring to FIG. 6, the first side 104 may include the first notch 130 at a first corner 138 of the wedge 102. The first notch 130 is adjacent to, and coextensive with, the second clip engagement portion 136 (where the second clip engagement portion 136 is part of the second side 106 of the wedge 102). Similarly, the second side 106 may include the second notch 132 at a second corner 140 of the wedge 102. The second notch 132 is adjacent to, and coextensive with, the first clip engagement portion 134 (where the first clip engagement portion 134 is part of the first side 104 of the wedge 102).

While using the abovementioned clips may be preferable in many circumstances, the depicted wedge 102 also includes structures for receiving bolts, which is advantageous for accommodating situations where bolt connects are deemed superior and/or where the secured shoring components are not compatible with the securement clip 120. In particular, the wedge 102 includes a first bolt hole 142 and a second bolt hole 144. The first side 104 of the wedge 102 includes a first bolt retainer 146 adjacent to the first bolt hole 142. The first bolt retainer 146 may include a hex pattern that receives the head of a bolt and prevents the same from spinning as a corresponding nut is tightened, which allows the bolt to be tightened with only one tool (rather than needing a second to prevent rotation of the bolt while the nut rotates). This is particularly advantageous where due to the compact nature of the wedge 102, reaching a tool to the bolt's head would be difficult or impossible during the assembly process. Similarly, the second side 106 includes a second bolt retainer 148 located adjacent to the second bolt hole 144.

Referring to FIG. 6, at least one of the first engagement surface 108 and the second engagement surface 110 may optionally include a slightly-convex profile rather than being perfectly flat. This convex curvature may be advantageous for removing a certain amount of "slop" or imprecision of engagement with the secured shoring components, as such components are not always perfectly flat. While this slight convexity may prevent perfect flushness between components, this is easily addressed once the wedge 102 and the secured shoring components are secured together via the structures and method discussed above. Notably, when convex surfaces are included, the wedge angle 112 can be determined by measuring the angle between a geometric average of all normal planes of the first engagement surface 108 and a geometric average of all normal planes of the second engagement surface 110.

While various embodiments have been described, it will be apparent to those of ordinary skill in the art that many more embodiments and implementations are possible. Accordingly, the embodiments described herein are examples, not the only possible embodiments and implementations.

Having described various aspects of the subject matter above, additional disclosure is provided below that may be consistent with the claims originally filed with this disclosure. In describing this additional subject matter, reference may be made to the previously described figures. Any of the following aspects may be combined, where compatible.

One general aspect includes a wedge for a shoring system, a first side with a first engagement surface and a second side with a second engagement surface, where the first engagement surface is configured for engaging a drophead of the shoring system, and where the second engagement surface is configured for engaging a shore of the shoring system. The wedge also includes and a first pocket on the first side of the wedge, where the first pocket is configured for receiving a bottom portion of the drophead, where the first engagement surface is angled between about 8 degrees and about 12 degrees relative to the second engagement surface as it extends away from the first pocket.

Implementations may include one or more of the following features. The wedge may include a second pocket adjacent to a second surface on the second side of the wedge, where the second pocket is configured for receiving a top portion of the shore. The first side and the second side are interchangeable. The first side includes a first center stem configured for receipt in a central drophead opening of the bottom portion of the drophead. The second side includes a second center stem configured for receipt in a central shore opening of a top portion of the shore. At least a portion of a top face of the first center stem includes an angled face that is angled relative to the first engagement surface. The first side of the wedge includes a first notch adjacent to a clip engagement portion of the second side of the wedge such that a first cavity is formed for receipt of a first clip when the wedge is secured to at least one of the drophead and the shore. The second side of the wedge includes a second notch adjacent to a clip engagement portion of the first side of the wedge such that a second cavity is formed for receipt of a second slip when the wedge is secured to both of the drophead and the shore. The first notch is located in a first corner of the wedge and where the second notch is located at a second corner of the wedge. At least one of the first engagement surface and the second engagement surface includes a convex profile. At least one bolt hole extends through the wedge from the first side to the second side, and where a bolt retainer is located adjacent to the bolt hole on at least one of the first side and the second side of the wedge. The first side includes a first bolt retainer located adjacent to a first bolt hole and where the second side includes a second bolt retainer located adjacent to a second bolt hole.

Another aspect includes a wedge for a shoring system having a first side with a first engagement surface and a second side with a second engagement surface, where the first engagement surface is angled between about 8 degrees and about 12 degrees relative to the second engagement surface, and where the first side and the second side are interchangeable such that each of the first side and the second side are configured for engaging both of a top portion of a shore and a bottom portion of a drophead.

Implementations may include one or more of the following features. The wedge where the first side of the wedge includes a first pocket and a second pocket, where each of the first pocket and the second pocket is configured for receipt of an edge of the bottom portion of the drophead. The first side includes a first center stem configured for receipt in a central drophead opening of the bottom portion of the drophead, and where at least a portion of a top face of the first center stem includes an angled face that is angled relative to the first engagement surface. The first side of the wedge includes a first notch adjacent to a clip engagement portion of the second side of the wedge such that a first cavity is formed for receipt of a first clip when the wedge is secured to at least one of the drophead and the shore. At least one bolt hole extends through the wedge from the first side to the second side, and where a bolt retainer is located adjacent to the bolt hole on at least one of the first side and the second side of the wedge. The first side includes a first bolt retainer located adjacent to a first bolt hole and where the second side includes a second bolt retainer located adjacent to a second bolt hole.

Another aspect includes a wedge for a shoring system, a first side having a first engagement surface located at least partially on a first rib. The wedge also includes and a second side having a second engagement surface located at least partially on a second rib, where the first rib and the second rib are mirrored in geometry about a central plane of the wedge such that the first engagement surface and the second engagement surface are interchangeable.

Implementations may include one or more of the following features. The wedge where the first side includes a first pocket adjacent to the first engagement surface and where the second side includes a second pocket adjacent to the second engagement surface, where each of the first pocket and the second pocket are configured for receiving an edge of an adjacent shoring component of the shoring system.

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

This detailed description is provided in order to meet statutory requirements. However, this description is not intended to limit the scope of the invention described herein. Rather, the claimed subject matter may be embodied in different ways, to include different steps, different combinations of steps, different elements, and/or different combinations of elements, similar or equivalent to those described in this disclosure, and in conjunction with other present or future technologies. The examples herein are intended in all respects to be illustrative rather than restrictive. In this sense, alternative examples or implementations can become apparent to those of ordinary skill in the art to which the present subject matter pertains without departing from the scope hereof.

The invention claimed is:

1. A wedge for a shoring system, the wedge comprising:

a first side with a first engagement surface and a second side with a second engagement surface, wherein the first engagement surface is configured for engaging a drophead of the shoring system, and wherein the second engagement surface is configured for engaging a shore of the shoring system;

a first pocket on the first side of the wedge, wherein the first pocket comprises a bottom surface, a top surface that is spaced apart from the bottom surface, and a back surface, wherein a pocket opening is positioned between the top surface and the bottom surface and opposite the back surface, and wherein the first pocket is configured for receiving a bottom portion of the drophead; and a second pocket adjacent to the second engagement surface on the second side of the wedge, wherein the second pocket is configured for receiving a top portion of the shore, wherein the first engagement surface is angled between 8 degrees and about 12 degrees relative to the second engagement surface as the first engagement surface extends away from the first pocket.

2. The wedge of claim 1, wherein the first side and the second side are interchangeable.

3. The wedge of claim 1, wherein the first side includes a first center stem configured for receipt in a central drophead opening of the bottom portion of the drophead.

4. The wedge of claim 3, wherein the second side includes a second center stem configured for receipt in a central shore opening of the top portion of the shore.

5. The wedge of claim 3, wherein at least a portion of a top face of the first center stem includes an angled face that is angled relative to the first engagement surface.

6. The wedge of claim 1, wherein the first side of the wedge includes a first notch adjacent to a clip engagement portion of the second side of the wedge such that a first cavity is formed for receipt of a first clip when the wedge is secured to at least one of the drophead and the shore.

7. The wedge of claim 6, wherein the second side of the wedge includes a second notch adjacent to a clip engagement portion of the first side of the wedge such that a second cavity is formed for receipt of a second clip when the wedge is secured to both of the drophead and the shore.

8. The wedge of claim 7, wherein the first notch is located in a first corner of the wedge and wherein the second notch is located at a second corner of the wedge.

9. The wedge of claim 1, wherein at least one of the first engagement surface and the second engagement surface includes a convex profile.

10. The wedge of claim 1, wherein at least one bolt hole extends through the wedge from the first side to the second side, and wherein a bolt retainer is located adjacent to the bolt hole on at least one of the first side and the second side of the wedge.

11. The wedge of claim 1, wherein the first side includes a first bolt retainer located adjacent to a first bolt hole and wherein the second side includes a second bolt retainer located adjacent to a second bolt hole.

12. A wedge for a shoring system, the wedge comprising:

a first side with a first engagement surface and a second side with a second engagement surface, wherein a first pocket is disposed on the first side and a second pocket is disposed on the second side, wherein each of the first pocket and the second pocket comprise a top surface, wherein each top surface is angled relative to each respective engagement surface, wherein the first engagement surface is angled between about 8 degrees and about 12 degrees relative to the second engagement surface, and wherein the first side and the second side are interchangeable such that each of the first side and the second side are configured for engaging both of a top portion of a shore and a bottom portion of a drophead.

13. The wedge of claim 12, wherein the top surface of the first pocket extends parallel to a top face of a first center stem of the wedge, and wherein the top surface of the second pocket extends parallel to a top face of a second center stem of the wedge.

14. The wedge of claim 12, wherein the first side includes a first center stem configured for receipt in a central drophead opening of the bottom portion of the drophead, and wherein at least a portion of a top face of the first center stem includes an angled face that is angled relative to the first engagement surface.

15. The wedge of claim 12, wherein the first side of the wedge includes a first notch adjacent to a clip engagement portion of the second side of the wedge such that a first cavity is formed for receipt of a first clip when the wedge is secured to at least one of the drophead and the shore.

16. The wedge of claim 12, wherein at least one bolt hole extends through the wedge from the first side to the second side, and wherein a bolt retainer is located adjacent to the bolt hole on at least one of the first side and the second side of the wedge.

17. The wedge of claim 12, wherein the first side includes a first bolt retainer located adjacent to a first bolt hole and wherein the second side includes a second bolt retainer located adjacent to a second bolt hole.

18. A wedge for a shoring system, comprising:

a first side having a first engagement surface located at least partially on a first rib; and a second side having a second engagement surface located at least partially on a second rib, wherein the first side has a first pocket and the second side has a second pocket positioned below the first pocket, wherein the first pocket and the second pocket are mirrored in geometry relative to a central horizontal plane, wherein the first rib and the second rib are mirrored in geometry about the central horizontal plane of the wedge such that the first side and the second side are interchangeable.

19. The wedge of claim 18, wherein the first engagement surface is angled relative to the second engagement surface as the first engagement surface extends away from the first pocket.

20. A wedge for a shoring system, the wedge comprising:

a first side with a first engagement surface and a second side with a second engagement surface, wherein the first engagement surface is configured for engaging a drophead of the shoring system, wherein the second engagement surface is configured for engaging a shore of the shoring system, and wherein the first side includes a first center stem configured for receipt in a central drophead opening of a bottom portion of the drophead and the second side includes a second center stem configured for receipt in a central shore opening of a top portion of the shore; and a first pocket on the first side of the wedge, wherein the first pocket comprises a bottom surface, a top surface that is spaced apart from the bottom surface, and a back surface, wherein a pocket opening is positioned between the top surface and the bottom surface and opposite the back surface, and wherein the first pocket is configured for receiving the bottom portion of the drophead, wherein the first engagement surface is angled between about 8 degrees and about 12 degrees relative to the second engagement surface as the first engagement surface extends away from the first pocket.

* * * * *